US010792881B2

(12) United States Patent
Schalck et al.

(10) Patent No.: US 10,792,881 B2
(45) Date of Patent: Oct. 6, 2020

(54) METHOD AND MACHINE FOR PRODUCING BAGS

(71) Applicant: Holweg Group, Molsheim (FR)

(72) Inventors: Vincent Schalck, Holtzheim (FR); Dominique Morel, Obernai (FR); Freddy Oberhausser, Strasbourg (FR)

(73) Assignee: HOLWEG GROUP, Molsheim (FR)

( * ) Notice: Subject to any disclaimer, the term of this patent is extended or adjusted under 35 U.S.C. 154(b) by 333 days.

(21) Appl. No.: 15/537,621

(22) PCT Filed: Dec. 18, 2015

(86) PCT No.: PCT/EP2015/080531

§ 371 (c)(1),
(2) Date: Jun. 19, 2017

(87) PCT Pub. No.: WO2016/097310

PCT Pub. Date: Jun. 23, 2016

(65) Prior Publication Data

US 2018/0036987 A1 Feb. 8, 2018

(30) Foreign Application Priority Data

Dec. 19, 2014 (FR) ..... 14 62928

(51) Int. Cl.
*B31B 70/14* (2017.01)
*B31B 50/00* (2017.01)
(Continued)

(52) U.S. Cl.
CPC ..... *B31B 70/146* (2017.08); *B31B 50/00* (2017.08); *B31B 70/18* (2017.08); *B31B 70/148* (2017.08);
(Continued)

(58) Field of Classification Search
CPC ..... B31B 70/146; B31B 70/18; B31B 70/148; B31B 70/266; B31B 70/1614;
(Continued)

(56) References Cited

U.S. PATENT DOCUMENTS 2,129,842 A * 9/1938 Holweg ..... B31B 70/00 493/234
2,902,197 A * 9/1959 Potdevin ..... B65H 35/10 225/105
(Continued)

FOREIGN PATENT DOCUMENTS

DE 647889 7/1937
DE 10 2008 017726 10/2009
(Continued)

OTHER PUBLICATIONS

International Search Report dated Mar. 3, 2016 (4 pages including English translation) out of PCT priority application PCT/EP2015/080531.

*Primary Examiner* — Dariush Seif
(74) *Attorney, Agent, or Firm* — Brinks Gilson & Lione; John C. Freeman

(57) ABSTRACT

A method for producing a bag from a tube including transverse lines of perforations delimiting tabs of the future bag, a rear tab of a first bag being opposite a front tab of the second bag following the first. A first step involves separating the first and second bags; a second step involves separating a piece of waste remaining on one of the bags between the two tabs. The first and second steps are carried out between a first pair of separation cylinders and a second pair of cylinders, the piece of waste being clamped between the cylinders of the first pair during the first step in order to be held on the second bag, then clamped and torn off by the second pair during the second step.

13 Claims, 3 Drawing Sheets

(51) Int. Cl.

| | |
|---|---|
| ***B31B 70/18*** | (2017.01) |
| *B31B 150/00* | (2017.01) |
| *B31B 160/10* | (2017.01) |
| *B31B 70/16* | (2017.01) |
| *B31B 70/26* | (2017.01) |

(52) U.S. Cl.
CPC ..... *B31B 70/16* (2017.08); *B31B 70/266* (2017.08); *B31B 2150/00* (2017.08); *B31B 2150/003* (2017.08); *B31B 2160/10* (2017.08); *B31B 2160/102* (2017.08); *B31B 2160/106* (2017.08)

(58) Field of Classification Search
CPC ..... B31B 70/20; B31B 50/00; B31B 50/003; B31B 2160/102; B31B 2160/10; B31B 2160/106; B65B 41/16; B65B 61/005; B65B 61/04
USPC ..... 493/236, 239, 62, 288, 194, 199, 287; 53/389.3, 389.4, 548, 552
See application file for complete search history.

(56) References Cited

U.S. PATENT DOCUMENTS 3,114,299 A * 12/1963 Entzminger ..... B31B 70/00 493/239
3,133,479 A * 5/1964 Franklin ..... B31B 50/00 493/201
3,203,323 A * 8/1965 Adams ..... B31B 70/00 383/89
3,277,756 A * 10/1966 Des Jardins ..... B26D 7/1818 83/116
3,871,269 A * 3/1975 Jones ..... B65H 29/46 493/13
3,890,886 A * 6/1975 Fessler ..... B65B 25/08 493/369
4,209,956 A * 7/1980 Clayson ..... B65B 19/228 53/389.3
4,949,528 A * 8/1990 Palik ..... B09B 3/00 209/547
5,094,657 A * 3/1992 Dworak ..... B65B 9/087 156/323
5,403,428 A * 4/1995 Shingo ..... B42D 5/025 156/202
5,478,302 A * 12/1995 Bluemle ..... B65D 31/08 493/235
5,785,224 A * 7/1998 Nowakowski ..... B65H 35/10 225/100
6,722,108 B1 * 4/2004 Kotsiopoulos ..... B65B 57/06 53/238
7,712,287 B2 * 5/2010 Gallimore ..... B65B 61/20 225/100
8,752,460 B2 6/2014 Kroeger
9,221,229 B2 * 12/2015 Thies ..... B23K 26/0846
2002/0049125 A1 * 4/2002 Selle ..... B31B 70/00 493/416
2006/0128543 A1 * 6/2006 Sekine ..... B65H 45/16 493/355
2011/0100176 A1 * 5/2011 Kroeger ..... B26F 1/24 83/30
2011/0143901 A1 * 6/2011 Thies ..... B26F 1/04 493/227
2013/0040796 A1 * 2/2013 Thies ..... B23K 26/0846 493/239
2018/0319115 A1 * 11/2018 Fichtner ..... B31B 70/876

FOREIGN PATENT DOCUMENTS

FR 786579 9/1935
FR 829591 6/1938
FR 1159929 7/1958

* cited by examiner

METHOD AND MACHINE FOR PRODUCING BAGS

This application claims priority to International Application No. PCT/EP2015/080531 filed Dec. 18, 2015 and French Application No. 1462928 filed Dec. 19, 2014; the entire contents of each are incorporated herein by reference.

BACKGROUND

The present invention relates to a method for producing bags according to which, from a tubular body including lines of transverse perforations delimiting the tabs of the future bag, two separation steps are carried out along the lines of perforations for separating the two consecutive bags, and a piece of waste remaining on one of the bags between the two tabs. It also relates to a machine implementing said method.

To produce bags industrially, particularly of paper, a technique is known consisting of forming a tubular body from a sheet of paper in rolls, separating the segments starting from this tubular body and closing one of the ends of the segment to form a bag. The tubular body can also be constituted with a portion made of plastic, transparent for example, assembled by gluing with the paper by covering the respective edges.

Document FR 786 579 shows several examples of this technique. It shows in particular, in FIGS. 7 through 10, a method of production wherein a strip of paper is provided at regular intervals with lines of transverse perforations, with a single line at the center and two lines, respectively for the opening and the bottom, offset on either side with respect to the central line on each side of the sheet, the bottom line being seen as arriving after the central line in the direction of displacement of the paper, the opening line being seen as arriving before the central line. Lines of perforation diagonally connect the bottom line and the opening line to the central line.

There exists a particular case of a bag without a rear tab for which the opening line crosses the entire paper strip and is offset from the central line.

The tubular body is formed by folding each edge over the central portion and gluing the two edges along a central junction between them. The tubular body thus formed passes between a pair of drive cylinders which drive the tubular body at a constant speed. The tubular body passes between a pair of separating cylinders rotating with a higher peripheral speed than that of the drive cylinders before being driven toward a folding device. One of the cylinders of the pair of separation cylinders is hollowed out over a large portion of its perimeter so as to come into contact with the other cylinder only intermittently. During this contact, which occurs between the opening line and the central line, the tubular body is put into tension between the drive cylinders and the separation cylinders so as to obtain the separation of a segment derived from the tubular body at the central line of perforation and the bottom lines. The front portion of the segment which was just separated is then grasped by the folding device which rotates with a greater peripheral speed than that of the pair of separation cylinders. The pair of separation cylinders holds the separated segment at this time between the central line and the bottom line, that is only the upper portion of the segment, so that the portion of the segment between the opening line and the bottom line is separated from the segment, forming a piece of waste. The piece of waste is driven downward by the lower cylinder of the pair of separation cylinders equipped for this purpose with spikes that plant themselves in the waste piece between the central line and the bottom line. A rear tab is thus formed on the segment, likewise a front tab at the end of the tubular body. This front tab will be found on the following segment. The front and rear tabs are situated on the same side of the segment, that is in the lower portion. The front tab is bonded and folded by the folding device to close the front portion of the segment.

The ratios of peripheral speeds between the drive cylinders, the separation cylinders and the folding device are generally determined in a fixed manner by mechanical drives from the same drive motor.

The grasping of the waste piece on the rear side imposes limitations on the operating speed of the machine. In fact, the front portion of the waste piece can turn over because it is not held. This phenomenon is particularly noticeable with a great length of the waste piece and with a high rate of production. When the front portion turns over, it can bring about the detachment of the waste piece, which then risks being jammed in its removal path.

Variants have been provided to this technique. Document DE 647 889 shows an identical technique wherein the central line is subdivided into two lines so that the waste piece forms a complete ring.

Document FR 829 591 proposes to add a pair of cylinders between the pair of separation cylinders and the folding device, so as to be able to accomplish the operation of separation in lieu of the folding device. This document also proposes to add a pair of auxiliary cylinders between the drive cylinders and the separation cylinders, by clamping the tubular body only during the tearing operation.

It has also been proposed to add a pair of retrieval cylinders positioned downstream of the pair of separation cylinders, driven at an over-speed with respect to the speed of the tubular body. This makes it possible to grasp the front end of the tubular body after separation and cause it to retrieve the possible delay that the end may have incurred due to retention by the pair of separation cylinders. However, once the retrieval is accomplished, the over-speed induces friction of the catch-up cylinders on the tubular body and the wear of said cylinders, which can be rapid.

Document FR 1 159 929 proposes to distinguish the two separation operations by providing two stations between which the separation between the segment and the tubular body occurs and two other stations between which the second separation between the tubular body and the waste piece occurs. This arrangement tends to make the production machine bulky and expensive due to the multiplication of the number of stations. It can apply only to a machine the dimensions whereof have been made sufficient to accommodate supplementary stations, which is not the standard case.

SUMMARY

The invention aims to supply an alternative arrangement which simplifies the construction of the machine implementing the production method, which allows a compact machine and which facilitates the implementation of the method during adjustment depending on the format of the bags to be produced.

With these objectives in view, the invention has as its purpose a method for producing a bag according to which, starting with a tubular body including lines of transverse perforations delimiting a rear end of a first bag and at least one front tab of a second bag following the first between a central line and a bottom line, a first step occurs consisting of a separation of the first and of the second bag and, in a second step, separating a waste piece remaining on one of the bags between the rear end and the front tab, characterized in that the first and the second step are accomplished between, on the one hand, a first pair of separation cylinders and, on the other hand, a second pair of separation cylinders downstream of the first pair of separation cylinders with respect to the scrolling direction of the tubular body, the waste piece being clamped between the central line and the bottom line between the cylinders of the first pair during the first step to be retained on the second bag, then clamped and torn off by the second pair during the second step, the first pair of cylinders being driven with a lower peripheral speed than that of the second pair at least during the first and the second step.

The method according to the invention makes it possible to produce bags according to the same principle as in the prior art, but with only two pairs of separating cylinders, while the prior technique required at least one additional pair of cylinders to accomplish the second separation. The machine implementing the method according to the invention can thus be more compact because it uses the same two pairs of cylinders for accomplishing the two separation steps. For this reason it is less expensive due to the reduction in the number of pairs of cylinders and due to the reduction in the size of the machine. Another advantage is that the waste piece is carried at the front of the second bag, which makes it possible to grasp it by the front for its removal. Even if it is long, its removal is not affected, the long portion being located at the rear and not risking turning over or becoming detached. In fact, in the prior art, when the waste piece remains attached to the rear of the first bag, the only possibility for grasping it is the rearmost portion, and it becomes difficult to guide it during its removal, in particular in the case of a great length of the waste piece.

According to an original arrangement, the tubular body is driven upstream of the first pair of cylinders using a pair of drive rollers turning at a constant peripheral speed, called the reference speed, the peripheral speed of the first pair of cylinders being less than the reference speed during the first and the second step. During each step, the tubular body is thus retained by the first pair of cylinders, the portion of the tubular body between the pair of drive rollers and the first pair of cylinders being slackened and sometimes even temporarily forming a wave. This possible wave is absorbed thereafter when the first pair of cylinders no longer clamps the tubular body.

According to another arrangement, the speed of at least one of the cylinders of the first pair of cylinders is adjusted between the second and the first step so that the gripping of the waste piece between the cylinders of the first pair is synchronized with the gripping and the tearing off of the first bag by the second pair of cylinders. It must be possible to adjust the length of the bag on the machine. However, the length of the bag which runs between the clamping of the bag during the first, then during the second step, corresponds substantially to the distance between the first and the second pair of cylinders. In fact, during the first step the clamping by the first pair of cylinders takes place at the waste piece between the central line and the bottom line, to maintain it with the second bag. The clamping during the second step takes place when the waste piece maintained on the second bag is at the second pair of cylinders, hence after traveling a substantially fixed distance, which does not depend on the length of the bag. On the other hand, the interval between the gripping of the second step and that of the first step for the following bag depends on the length of the bag. It can therefore be advantageous to adjust the speed of rotation of the first pair of cylinders between the second and the first step to adapt the cycle to the length of the bag. The adjustment of the speed of rotation of the cylinders is accomplished for example by using a synchronous electric servo-motor. The means for adjusting the speed of the first pair of cylinders can also be utilized to adapt the peripheral speed during the first and the second step so as to limit the gap using the scrolling speed of the tubular body. Thus, the end of the tubular body has very little delay after the first separation step with respect to normal travel, and it is then not necessary to provide retrieval cylinders downstream of the first pair of cylinders. The speed gap can be adjusted for each type of production, depending on the format of the bags and the nature of the tubular body material.

Similarly, the speed of at least one of the cylinders of the second pair of cylinders is adjusted between the second and the first step so that the gripping of the first bag between the cylinders of the second pair is synchronized with the clamping of the waste piece by the first pair of cylinders. The peripheral speed of the second pair of cylinders is always greater than the peripheral speed of the first pair of cylinders during the first and the second step, but changes freely between the steps and could be more rapid or slower than the first cylinders and could be different depending on the format of the bags.

According to one application of the method, the lines of perforations also delimit a rear tab at the rear end of the first bag facing the front tab of the second bag.

The invention also has as its object a machine for producing bags including a station that forms a tubular body including lines of transverse perforations delimiting a rear end of a first bag and at least one front tab of a second bag following the first separator for, in a first step, accomplishing a separation of the first and second bags and, in a second step, separating a waste piece remaining on one of the bags between the rear end and the front tab, the machine being characterized in that the separator include a first pair of separation cylinders, driven by a first drive, and a second pair of separation cylinders, driven by a second drive, the separation means being configured to clamp the waste piece between the cylinders of the first pair during the first step and to retain it on the second bag while the second bag is clamped between the second pair of separation cylinders, the first and the second drives conferring a peripheral speed to the first pair of cylinders that is less than that of the second pair, at least during the first and the second step.

According to a complementary feature, a principal cylinder of the second pair of separation cylinders includes grasping means for seizing the waste piece during the second step. The grasping means make it possible to carry away the waste piece in the rotation of the cylinder which includes these means. These are conventionally a line of spikes, but it can also be a suction cup or an adhering surface. Other means are provide for then withdrawing the waste piece from the grasping means.

According to a first arrangement, the principal cylinder of the second pair of separation cylinders includes a clip for clamping the tubular body, the grasping means being retractable so as to be retracted during the first step. The same clip carries out the gripping during the first and the second step, which necessitates that the grasping means are retracted during the gripping of the first step. This arrangement makes it possible to optimize bulk and to reduce the minimum size of the bags.

According to a second arrangement, the principal cylinder of the second pair of separation cylinders includes a first tear-off clip for clamping the tubular body during the first step and a second tear-off clip for clamping the tubular body during the second step, the grasping means being positioned in the environment of the second tear-off clip. Each of the clips is dedicated to one of the steps, which makes it possible to carry out the two steps during one cycle of rotation of the principal cylinder. Such an arrangement makes it possible to obtain high rates of production and makes it possible to dispense with the mechanism for retracting the grasping means.

According to another constructive arrangement, the principal cylinder of the second pair of cylinders includes at least two tear-off clips, the grasper being positioned in the environment of all the tear-off clips or of one of two tear-off clip to clamp the tubular body during the first step with a clip not provided with a grasping device or the grasping device whereof is retracted, and a second tear-off clip with an operational grasping device for clamping the tubular body during the second step and grasping the waste piece. In this arrangement, it is possible, using a second drive, to accomplish clamping steps for the first step, either with the same clips or with different clips from those used during the second step. The two steps can be accomplished, depending on the adjustments selected, in less than one revolution of the principal cylinder, one revolution or even more than one revolution, which allows a high production rate over the entire range of formats. The tear-off clips can be positioned in a regular manner or variously offset.

According to one constructive arrangement, a principal cylinder of the first pair of separation cylinders includes a holding clip for clamping the tubular body during the first and the second step. Clamping on the clip is limited to the accomplishment of the separation steps, which leaves the possibility of conferring to the main cylinder which carries it or to the pair of cylinders an unconstrained rotation speed outside of these steps. The same clip is used for the first and for the second step, which allows a compact construction with a small diameter for the first pair of cylinders.

According to another constructive arrangement, a principal cylinder of the first pair of separation cylinders includes a first holding clip for clamping the tubular body during the first step and a second holding clip for clamping the tubular body during the second step. The two steps are accomplished during the same revolution of the principal cylinder, which allows a high production rate. The two holding clips can be positioned opposite one another or variously offset.

In one variant, a counter-cylinder of the first or of the second pair of cylinders includes an eroded zone, the corresponding drive being configurable so that the first tear-off clip or the second tear-off clip faces the eroded zone intermittently during rotation of the principal cylinder. This thus offers many adjustment possibilities by making it possible to achieve at least one passage of one of the clips facing the counter -cylinder without it being active because it is not able to clamp the bag or the tubular body due to being facing the eroded zone. The eroded zone can take the form of a groove, a flat or any other shape locally reducing the radius of the cylinder, and extending along a generator of the cylinder. The counter-cylinder can include several eroded zones.

BRIEF DESCRIPTION OF THE DRAWINGS

The invention will be better understood and other characteristics and advantages will appear upon reading the detailed description which follows, the description referring to the appended drawings wherein.

DETAILED DESCRIPTION

Figure 1:
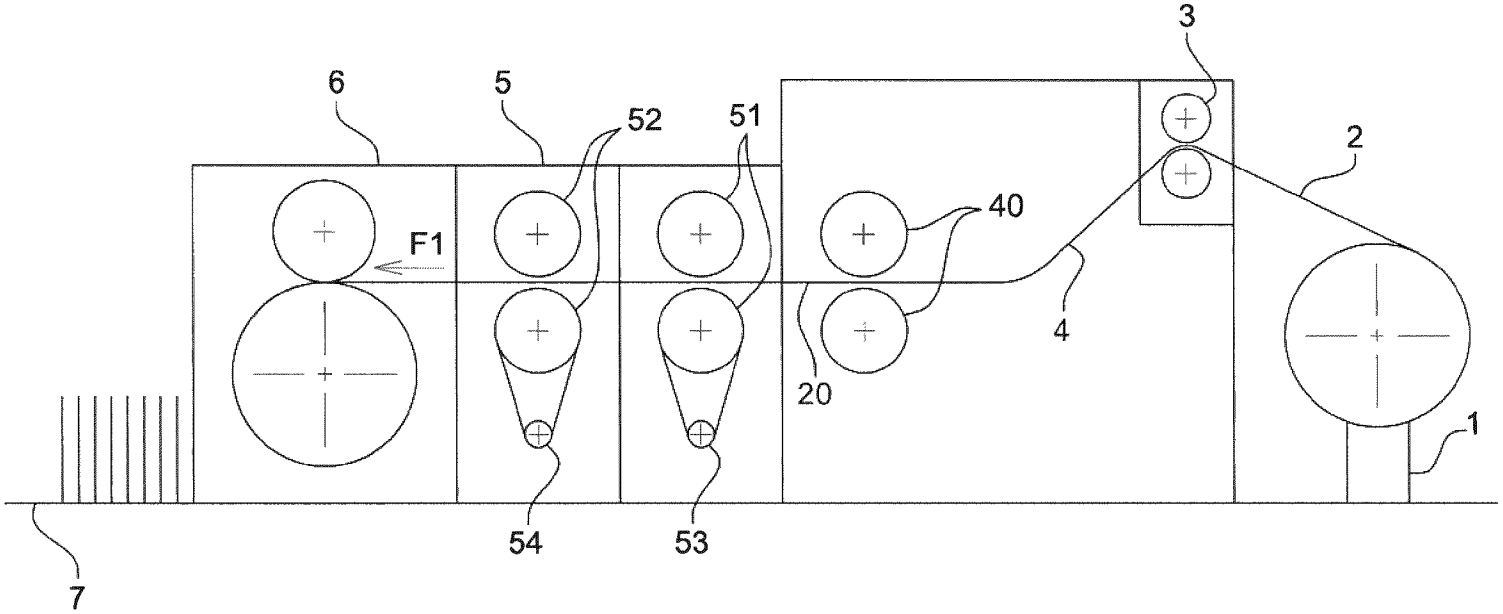
FIG. 1 is a schematic view of a machine implementing the method according to the invention.

A machine conforming to an embodiment of the invention is shown schematically in FIG. 1. It includes successively in the unwinding direction an unwinding device 1 receiving a strip of paper 2 in a spool, to unwind it, a perforation station 3 for creating transverse perforations on the paper strip 2 which unwinds, a station for forming a tubular body 4, separation means 5 for separating the tubular body 20 into successive bag blanks, a folding device 6 for forming the bottom of each bag and a reception table 7 for piling the bags produced. The station for forming a tubular body 4 is terminated by a pair of drive rollers 40 rotating at a constant peripheral speed called the reference speed. The machine also includes transport means, not shown, positioned between the different stations for guiding and transporting the tubular body 20 or the blanks between stations. Only the separation means 5 are modified within the scope of this invention; the other equipment will therefore not be described in detail.

Figure 2:
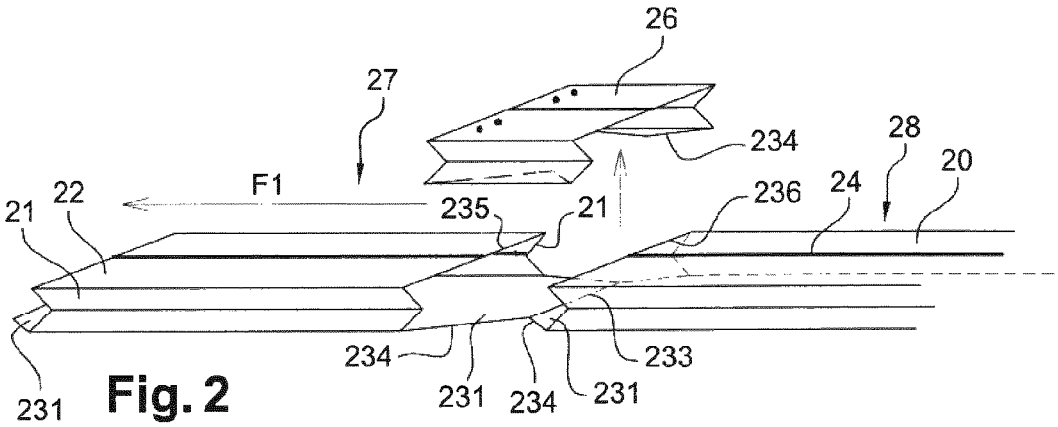
FIG. 2 is a perspective view of a tubular body on which are shown the limits of the bags to be produced.
Figure 3:
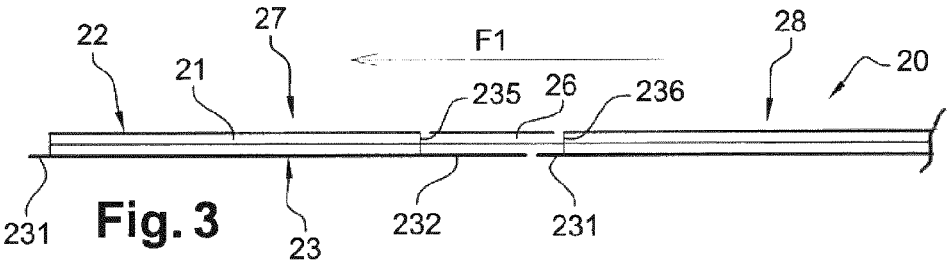
FIG. 3 is a side view of the tubular body in FIG. 2.

In FIGS. 2 and 3, the tubular body 20 shown includes gussets 21, but it should be understood that the invention also applies to a simple tubular body 20, for bags not provided with gussets. Thus the tubular body 20 has an upper face 22 facing a lower face 23, the faces 22, 23 being interconnected by lateral gussets 21. The tubular body 20 is made by bonding together the edges of the original paper strip 2, the superimposed edges meeting substantially in the middle 24 of the upper face 22. The tubular body 20 is designed to be separated into a first bag 27, a waste piece 26 and a second bag 28 following the first bag 27, knowing that in the following cycle, the first bag 27 will be replaced by the second bag 28 and so on. On the rear side, the first bag 27 includes a rear tab 232 coming from the lower face 23 of the tubular body 20, and delimited by a central line 233 in the transverse direction and two diagonal lines 234 reaching the gussets 21. The gussets 21 and the upper face 22 are cut at the same transverse level as an opening line 235 of which the rear tab 232 projects rearward.

The second bag 28 includes a front tab 231 coming from the lower face 23 of the tubular body 20, and delimited by a central line 233 in the transverse direction and two diagonal lines 234 reaching the gussets 21. The gussets 21 and the upper face 22 are cut at the same transverse level as a bottom line 236 of which the front tab 231 projects forward. The portion of the tubular body 20 delimited between the diagonal lines 234 and between the bottom 236 and opening 235 lines on the upper face 22 forms the waste piece 26 which will be extracted. The rear tab 232 of the first bag 27 thus faces the front tab 231 of the second bag 28.

The perforation station 3 creates perforations on the entire width of the paper strip 2, at regular intervals. The perforations extend along the central line 233, diagonal lines 234, the opening line 235 and the bottom line 236 delimiting the bags on the upper face 22 and the gussets 21.

Referring to FIG. 1, the separator 5 of the production machine include a first pair of separation cylinders 51 driven by a first drive 53, and a second pair of separation cylinders 52, driven by a second drive 54. The cylinders of the same pair in the upper portion turn at the same peripheral speed as the cylinders in the lower portion but in the opposite direction, so as to accompany the scrolling of the tubular body 20 together. The first pair of separation cylinders 51 comprises a first holding clip 511 and a second holding clip 512. Likewise, the second pair of separation cylinders 52 includes a first tear-off clip 521 and a second tear-off clip 522. The holding 511, 512 and tear-off 521, 522 clips are attached to a principal cylinder of the corresponding pair, in the present case to the cylinder facing the upper face 22 of the tubular body 20, in the direction of the generators of the cylinder, and form a protruding portion with respect to the surface of the cylinder, so as to form a clamp which holds the tubular body during passage of the clip facing the other cylinder, called the counter-cylinder. The counter-cylinders are smooth. Grasper 523 in the form of a line of spikes are positioned in proximity to the second tear-off clip 522.

The method implemented by the machine will now be described beginning with an arbitrary position, knowing that each position is found again in the following cycle. The method is a succession of cycles, one bag being produced for each cycle.

Figure 4:
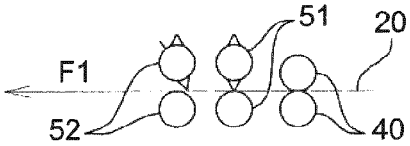
FIG. 4 is a schematic view of the separation means in a position at the beginning of the first separation step.
Figure 5:
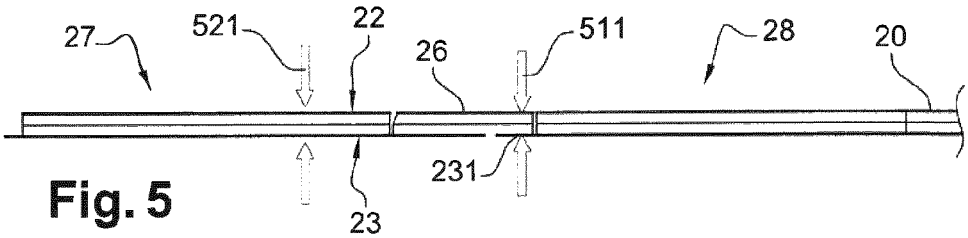
FIG. 5 is a schematic view of the tubular body in the position of FIG. 4.
Figure 6:
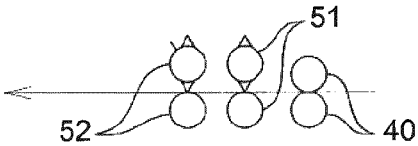
FIGS. 6 and 7 are similar views to FIGS. 4 and 5 in a final position of step 1.
Figure 7:
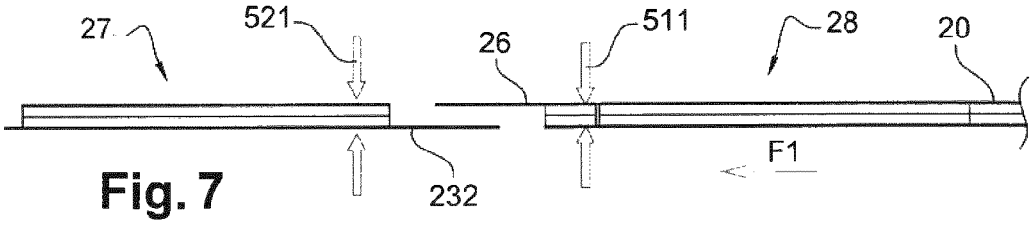

In the position shown in FIGS. 4 and 5, the first and the second bag 27, 28 are contiguous in the continuation of the tubular body 20. The first bag 27 is located between the cylinders of the second pair of cylinders 52 while the second bag 28 is located upstream of the first pair of cylinders 51. The tubular body 20 is moving in the direction of the arrow F1, to with from the first pair of cylinders 51 toward the second pair of cylinders 52. In a first step, the pairs of cylinders 51, 52, driven by the first drive and the second drive 53, 54, bring the first holding clip 511 into contact with the front tab 231 of the second bag 28 and the waste piece 26 by clamping them between the central line 233 and the bottom line 236 while the first tear-off clip 521 comes into contact with the upper and lower faces 22, 23 of the second bag 28 while clamping them. The differential peripheral speeds of each pair of cylinders 51, 52, to with a lower peripheral speed than the reference speed for the first pair of cylinders 51, bring about tension between the first and the second bag 27, 28 so as to obtain their separation along the perforations of the central line 233, the opening line 235 and the diagonal lines 236 connecting them, as shown in FIGS. 6 and 7. The rear tab 232 of the first bag 27 is thus formed. The waste piece 26 remains attached to the second bag 28.

Figure 8:
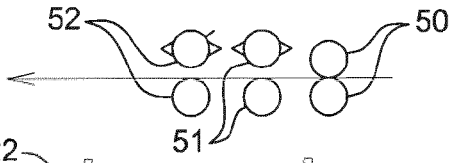
FIGS. 8 and 9 are similar views to FIGS. 4 and 5 in a position between the first and the second step.
Figure 9:
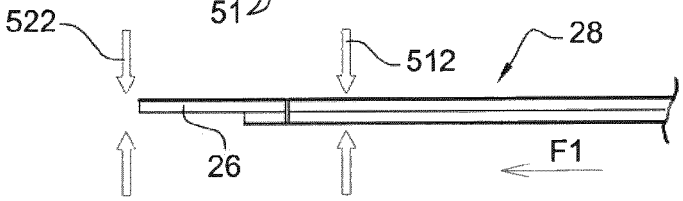
Figure 10:
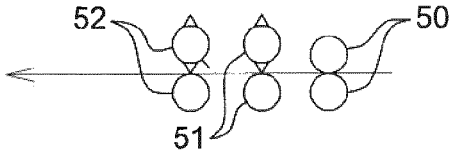
FIGS. 10 and 11 are similar views to FIGS. 4 and 5 in a position at the beginning of the second step.
Figure 11:
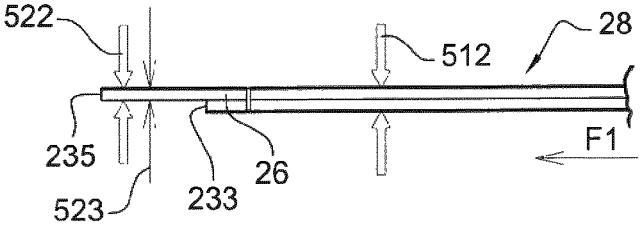

The scrolling of the tubular body 20 and of the first bag 27 continues in the direction of the arrow F1 to the position shown by FIGS. 8 and 9, wherein the waste piece 26 arrives in proximity to the second pair of cylinders 52 and the second bag 28 is between the cylinders of the first pair of cylinders 51. In a second step, the pairs of cylinders 51, 52 bring the second holding clip 512 into contact with the second bag 28 while clamping it, while the second tear-off clip 522 comes into contact while clamping it with the waste piece 26 projecting beyond what will be the front tab 231 of the second bag 28, that is between the central line 233 and the opening line 235, as shown in FIGS. 10 and 11.

Figure 12:
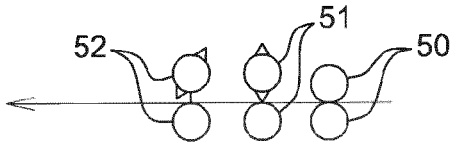
FIGS. 12 and 13 are similar views to FIGS. 4 and 5 in a position at the end of the seconds step.
Figure 13:
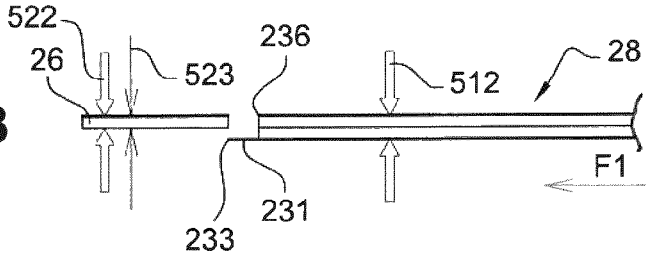

The differential peripheral speeds of each pair of cylinders bring about tension between the waste piece 26 and the second bag 28 so as to obtain their separation along diagonal 234 and bottom 236 perforation lines, as shown in FIGS. 12 and 13. The front tab 231 of the second bag 28 is thus formed. The waste piece 26 is spurred toward the front by the grasping means 523 and removed with the rotation of the principal cylinder, in a manner known per se.

Once the first bag 27 is separated from the tubular body 20, it is transferred to the folding device 6 which bonds, then folds over the front tab 231 over the upper face 22 so as to close the end of the bag. This device is conventional and is not described here in more detail.

Other than in the first and the second phase, the clips do not carry out clamping on the other cylinder of the pair. Thus, these periods without position constraints are used for accelerating or slowing down the rotation speeds of the cylinders so that the following clamping occurs at the chosen time with respect to the position of the tubular body 20 and to the desired speed. These adjustments in speed are adapted to each bag length.

Figure 14:
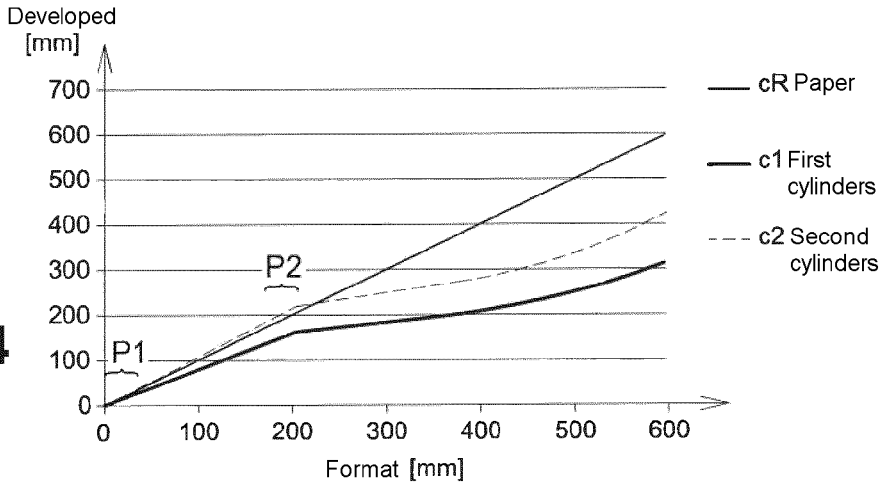
FIG. 14 shows a time diagram of the rotation speeds of a first and a second pair of cylinders.

Consider a machine the pairs of cylinders 51, 52 whereof rotate synchronously, at one revolution per bag produced. The cylinders of the first pair have a developed perimeter of 320 mm while those of the second pair have a developed perimeter on the order of 430 mm. The counter-cylinders are smooth while the main cylinder of each pair carries two diametrically opposed clips. The developed perimeter ratio determines in principle the speed ratio during the first and the second phase, so as to obtain the separation of the tubular body or the waste piece. With reference to FIG. 14, a diagram shows on a first curve c1 the peripheral position of the first pair of cylinders as a function of the scrolling of the coil, on a second curve c2 the peripheral position of the second pair of cylinders and on a third curve the reference position cR for the coil. It is noted that the curves c1 and c2 are synchronous, the peripheral speed of the second pair of cylinders 52 being greater than that of the first 51. During the first step, the speeds, corresponding to the slope of the curves, are such that the speed of the first curve c1 is less than the speed of the second curve c2 and to that of the reference curve cR to accomplish the separation between the first and the second bag. There follows a first transition step wherein the peripheral speeds of the first and of the second pair of cylinders are held constant. During the second step P2, the slopes of the curves c1, c2 are always identical to those during the first step P1. There follows finally a second transition step wherein the peripheral speeds of the first and of the second pair of cylinders 51 are slowed down, then again accelerated so as to synchronize the end of the length of the bag with the end of a rotation of each pair of cylinders 51, 52 while still returning to the peripheral speeds for carrying out the first step. The cycle is then ended and the following cycle resumes at the first step P1.

If the tear-off clips did not have a relative angular position identical to that of the holding clips, it would be necessary to cause the rotation speeds of each pair of cylinders to change independently.

In one variant, not shown, the cylinders in the lower portion turn at a constant speed, and only the speed of the cylinders carrying the clips are adjusted. The result is lower inertia of the movable portion which undergoes accelerations. It is however necessary to provide at least one other motor for the counter-cylinders.

The invention is not limited to the embodiment that has just been described. The clips can positioned by pairs on one and the other cylinders of the same pair. It is also possible to provide only one clip per pair of cylinders, the cylinders carrying out two rotations per cycle to accomplish clamping both in the first and in the second step. This solution can apply to one of the pairs of cylinders or to both. When it applies to the second pair of cylinders, it is necessary that the grasping means be retractable so as to be active only during the second step.

The invention claimed is:

1. A method for producing a bag according to which, starting from a tubular body comprising lines of perforations formed along a transverse direction, wherein a central perforation line separates a rear end of a first bag and a front tab of a second bag following the first bag, wherein the tubular body comprises an opening perforation line from which a rear tab of the first bag projects rearward, wherein the tubular body comprises a bottom perforation line from which the front tab of the second bag projects forward, the method comprising:

separating the first bag and the second bag; and, separating a waste piece remaining on the second bag, the waste piece presenting a length less than a length of the first bag and less than a length of the second bag;

wherein the separating the first bag and the second bag and the separating the waste piece are accomplished between-a first pair of separation cylinders and a second pair of separation cylinders downstream of the first pair of separation cylinders with respect to a scrolling direction of the tubular body, wherein the waste piece is clamped between the central perforation line and the bottom perforation line between the first pair of separation cylinders during the separating the first bag and the second bag to be retained on the second bag, wherein the waste piece is clamped and pierced by the second pair of separation cylinders between the opening perforation line and the central perforation line, and as a result to be torn off during the separating the waste piece, wherein the first pair of separation cylinders is driven at a first peripheral speed that is lower in magnitude than a second peripheral speed of the second pair of separation cylinders during the separating the first bag and the second bag and, during the separating the waste piece;

wherein upstream of the first pair of separation cylinders the tubular body is driven using a pair of drive rollers turning at a constant peripheral reference speed;

wherein during a first transition between the separating the first bag and the second bag and the separating the waste piece, the first peripheral speed of the first pair of cylinders is adapted so as to limit a gap between the first peripheral speed of the first pair of cylinders and the constant peripheral reference speed; and wherein during a second transition following the separating of the waste piece, the first peripheral speed of the first pair of cylinders and the second peripheral speed of the second pair of cylinders are slowed down, then again accelerated so as to synchronize an end of the length of the first bag with an end of a rotation of each of the first pair of cylinders and the second pair of cylinders while still returning to the first peripheral speed and the second peripheral speed for carrying out the first transition of an ensuing cycle.

2. The method according to claim 1, wherein upstream of the first pair of separation cylinders the tubular body is driven using a pair of drive rollers turning at a constant peripheral reference speed, and wherein the first peripheral speed of the first pair of separation cylinders is less in magnitude than the constant peripheral reference speed during the separating the first bag and the second bag and the separating the waste piece.

3. The method according to claim 1, wherein the waste piece remains on the second bag.

4. A machine for producing bags comprising:

a station that forms a tubular body comprising lines of perforations formed along a transverse direction, wherein a central perforation line separates a rear end of a first bag and a front tab of a second bag following the first bag, wherein the tubular body comprises an opening perforation line from which a rear tab of the first bag projects rearward, wherein the tubular body comprises a bottom perforation line from which the front tab of the second bag projects forward, a first pair of driven separation cylinders for separating the first bag and the second bag;

downstream of the first pair of driven separation cylinders, a second pair of driven separation cylinders for separating a waste piece remaining on the second bag, the waste piece presenting a length less than a length of the first bag and less than a length of the second bag, upstream of the first pair of separation cylinders, a pair of drive roller driving the tubular body and turning at a constant peripheral reference speed, wherein the first pair of driven separation cylinders and the second pair of driven separation cylinders are configured to clamp the waste piece between the central perforation line and the bottom perforation line between the first pair of driven separation cylinders during the separating the first bag and the second bag and to retain the waste piece on the second bag while the first bag is clamped between the second pair of driven separation cylinders, wherein the first pair of driven separation cylinders and the second pair of driven separation cylinders are configured to clamp and to pierce the waste piece been the opening perforation line and the central perforation line to tear it off with the second pair of driven separation cylinders during the separating the waste piece while the second bag is clamped between the first pair of driven separation cylinders, wherein a first peripheral speed of the first pair of driven separation cylinders is less than a second peripheral speed of the second pair of driven separation cylinders during the separating the first bag and the second bag and during the separating the waste piece;

wherein during a first transition between the separating the first bag and the second bag and the separating the waste piece, the first peripheral speed of the first pair of cylinders is adapted so as to limit a gap between the first peripheral speed of the first pair of cylinders and the constant peripheral reference speed; and wherein during a second transition following the separating of the waste piece, the first peripheral speed of the first pair of cylinders and the second peripheral speed of the second pair of cylinders are slowed down, then again accelerated so as to synchronize an end of the length of the first bag with an end of a rotation of each of the first pair of cylinders and the second pair of cylinders while still returning to the first peripheral speed and the second peripheral speed for carrying out the first transition of an ensuing cycle.

5. The machine according to claim 4, wherein a first cylinder of the second pair of driven separation cylinders comprises a grasper that spikes the waste piece during the separating the waste piece.

6. The machine according to claim 5, wherein the first cylinder of the second pair of driven separation cylinders comprises a tear-off clip for clamping the tubular body, the grasper being retractable so as to be retracted during the separating the first bag and the second bag.

7. The machine according to claim 5, wherein the first cylinder of the second pair of driven separation cylinders comprises:

a first tear-off clip for clamping the tubular body during the separating the first bag and the second bag; and a second tear-off clip for clamping the tubular body during the separating the waste piece, the grasper being positioned in proximity to the second tear-off clip.

8. The machine according to claim 5, wherein the first cylinder of the second pair of driven separation cylinders comprises a first tear -off clip and a second tear-off clip, the grasper being positioned in an environment of at least one of the first tear-off clip and the second tear-off clip to clamp the tubular body during the separating the first bag and the second bag with a clip not provided with the grasper or the grasper whereof is retracted, and wherein the second tear-off clip is associated with the grasper for clamping the tubular body during the separating the waste piece and clamping the waste piece.

9. The machine according claim 4, wherein a first cylinder of the first pair of driven separation cylinders comprises a holding clip for clamping the tubular body during the separating the first bag and the second bag and the separating the waste piece.

10. The machine according to claim 4, wherein a first cylinder of the first pair of driven separation cylinders comprises:

a first holding clip for clamping the tubular body during the separating the first bag and the second bag; and a second holding clip for clamping the tubular body during the separating the waste piece.

11. The machine according to claim 4, wherein a counter-cylinder of the first pair of driven separation cylinders or of the second pair of driven separation cylinders comprises an eroded zone, and a corresponding drive being configurable so that a first tear-off clip of the first pair of driven separation cylinders or a second tear-off clip of the second pair of driven separation cylinders faces the eroded zone intermittently during rotation of a first cylinder of the pair of driven separation cylinders or of the second pair of driven separation cylinders.

12. The machine according to claim 4, wherein the waste piece remains on the second bag.

13. The machine according to claim 4, further comprising a synchronous electric servo-motor and wherein the first peripheral speed of the first pair of cylinders and the second peripheral speed of the second pairs of cylinders are changed together or independently by using the synchronous electric servo-motor.

* * * * *